United States Patent [19]

Nikly

[11] 4,214,560

[45] Jul. 29, 1980

[54] CYLINDER HEAD IMPROVEMENT, PARTICULARLY FOR A DIESEL ENGINE

[76] Inventor: Jean M. Nikly, 2 Rue Le Royer, Lyons, France, 7

[21] Appl. No.: 902,717

[22] Filed: May 4, 1978

[30] Foreign Application Priority Data

May 4, 1977 [FR] France ..... 77 14305

[51] Int. Cl.[2] ..... F01P 3/14; F01P 3/16

[52] U.S. Cl. ..... 123/41.77; 123/41.31; 123/41.82 R; 123/193 H; 123/52 MC

[58] Field of Search ..... 123/41.77, 41.31, 41.82 R, 123/41.28, 52 MC, 52 M, 188 M, 191 L, 191 M, 193 H, 193 CH

[56] References Cited

U.S. PATENT DOCUMENTS

| | | | |
|---|---|---|---|
| 2,533,442 | 12/1950 | Falcon | 123/41.82 R |
| 2,788,776 | 4/1957 | Holt | 123/41.82 R |
| 3,483,856 | 12/1969 | Lovestrand | 123/193 H |
| 3,491,731 | 1/1970 | Dinger et al. | 123/41.77 |
| 3,500,805 | 3/1970 | Reisacher | 123/188 M |
| 3,889,644 | 6/1975 | Moore | 123/41.77 |
| 3,949,724 | 4/1976 | Nickly | 123/41.82 R |
| 4,121,550 | 10/1978 | Wand et al. | 123/41.82 R |

FOREIGN PATENT DOCUMENTS

| | | | |
|---|---|---|---|
| 2058096 | 1/1972 | Fed. Rep. of Germany | 123/193 H |

*Primary Examiner*—Charles J. Myhre
*Assistant Examiner*—Jeffrey L. Yates
*Attorney, Agent, or Firm*—Irving M. Weiner; Pamela S. Burt; Melvin Yedlin

[57] ABSTRACT

The invention concerns an improved cylinder head.

The cylinder head is fixed to the engine block by means of two short bolts 13 and 14 and four long bolts 15 to 18, all arranged at the points of a regular hexagon. The inlet and exhaust manifolds 20 and 21 are on the same side, on each side of the bolt 13, opposite to the rocker arm push-rods 9 and 10, and an injector carrier 34 placed obliquely above the bolt 14. The cooling liquid arrives under the inlet manifold 20, passes between the valves 5 and 6, and then directly cools the injector carrier 34.

Application: reduction in the bulk of the upper part of the engine as regards width.

10 Claims, 12 Drawing Figures

CYLINDER HEAD IMPROVEMENT, PARTICULARLY FOR A DIESEL ENGINE

BACKGROUND OF THE INVENTION

The present invention relates to a novel cylinder head principally for a diesel engine.

The invention provides a cylinder head, the internal arrangement of which results in an appreciable reduction in the bulk of the engine.

SUMMARY OF THE INVENTION

A cylinder head according to the invention is characterized in that the inlet manifold and the exhaust manifold are disposed on the same side, opposite to the rocker arms and the injector, the fixing of this cylinder head onto the engine block being carried out by means of six bolts, each occupying one point of a regular hexagon which has two sides perpendicular to the central longitudinal plane of the engine.

According to an additional characteristic of the invention, the inlet manifold opens on to the upper face of the cylinder head, whilst the exhaust manifold opens onto a side face of the cylinder head.

According to an additional characteristic of the invention, the cylinder head is fixed to the engine block by four long bolts, the heads of which bear on the upper surface of the cylinder head, and by two short bolts located in recesses symmetrical in relation to the central longitudinal plane of the engine respectively between the inlet and exhaust manifolds and above the injector carrier, the latter being inclined from the vertical. Ribs are provided to the bearing zones of the cylinder head onto the collar of the corresponding cylinder liner, each rib stretching between a short bolt and a long bolt.

A circuit for cooling liquid in the cylinder head may have an entry situated below the inlet manifold, the cooling liquid then being channelled so as to be directed on the one hand towards the valve bridge and on the other hand onto the injector boss.

The cooling liquid circuit may comprise a passage situated below the exhaust pipe, this passage having a smaller section than the passage located between the valves.

Preferably the walls separating the channels of the cooling circuit from the space for the rocker arms are, overall, sloping upwards from the entry of the cooling circuit, lying below the inlet manifold, to the outlet of the cooling circuit, lying alongside the injector.

Preferably the lowest point of the bowl for the rocker arms on the upper face of the cylinder head is located level with the hold which receives the push-rod of the exhaust rocker, this hole being larger than that receiving the rod of the inlet rocker, in order to allow the oil to fall back into the engine block.

By way of example, specific embodiments of the invention will now be described, with reference to the accompanying drawings.

DETAILED DESCRIPTION OF PREFERRED EMBODIMENT

Figure 1:
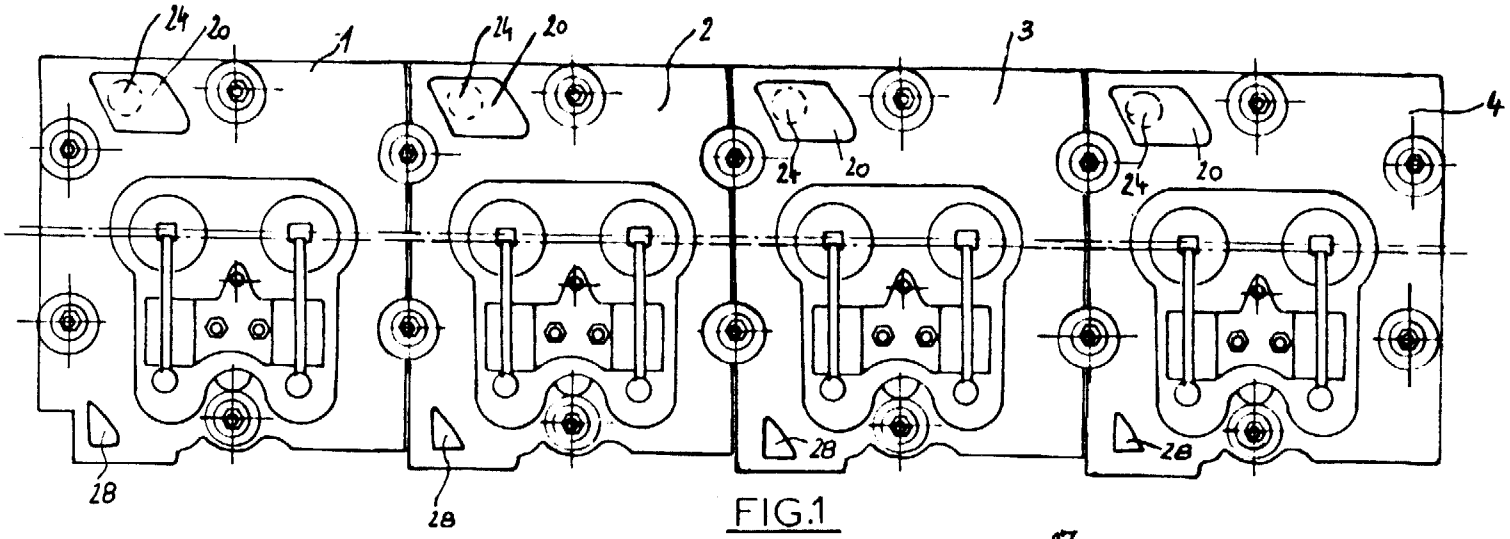
FIG. 1 is a plan view of an engine fitted with four single-cylinder heads according to the invention.

FIG. 1 depicts a four-cylinder engine fitted with single-cylinder cylinder heads 1 to 4 according to the invention. One of these cylinder heads is shown in detail in FIGS. 4 to 11.

In the conventional manner, this cylinder head carries an inlet valve 5 and an exhaust valve 6 controlled by rocker arms 7 and 8 disposed in the upper part of the cylinder head, these arms being operated by push-rods 9 and 10 passing through the head in vertical holes 11 and 12. Holes 11 and 12 are located proximal to a lateral edge of the head, which is attached to the engine block by means of six bolts 13 to 18 each occupying one of the points of a regular hexagon which has two sides perpendicular to the central longitudinal plane of the engine. The bolts 13 and 14, which are diametrically opposed in relation to the axis of the corresponding cylinder, are short bolts, while the bolts 15 to 18 are long bolts which straddle two heads when two heads are located side by side. The center of the regular hexagon approximates closely to the axis of the cylinder, which ensures a particularly good clamping of the head. As may be seen in FIGS. 6 and 8 in particular, four ribs 19 are provided in the lower part of the head at right angles to the bearing zone of the head on the collar of the liner of the corresponding cylinder. Each rib extends between a short bolt and a long bolt.

Figure 2:
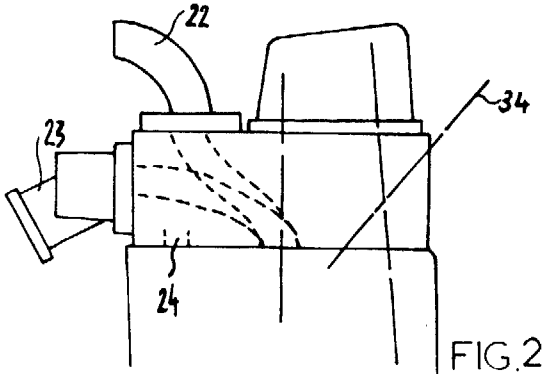
FIG. 2 is a schematic end view of the engine of FIG. 1.
Figure 4:
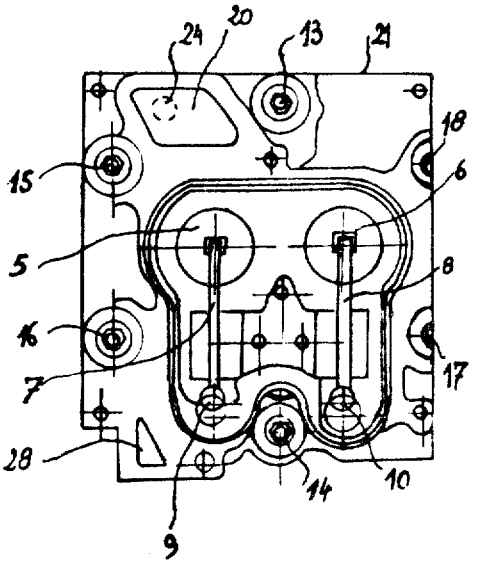
FIG. 4 is a detailed plan view of a single cylinder head according to the invention fitted with its rocker arms.
Figure 5:
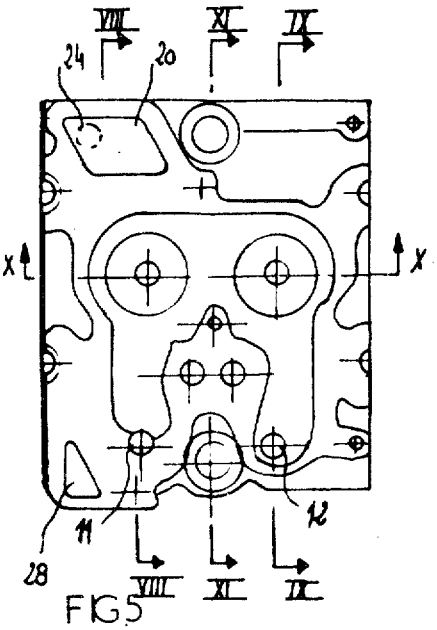
FIG. 5 is a plan view of the cylinder head of FIG. 4, without the rocker arms.

In accordance with the invention, the inlet manifold 20 and the exhaust manifold 21 are situated on the same side of the head, opposite to the push-rods 9 and 10 controlling the rocker arms. The flange 22 of the inlet manifold is fixed to the upper face of the head, while the flange 23 of the exhaust manifold is fixed to the corresponding lateral face of the head. (FIG. 2). The injector carrier 34 is set obliquely between the rocker push-rods above the short head fixing bolt 14.

Figure 3:
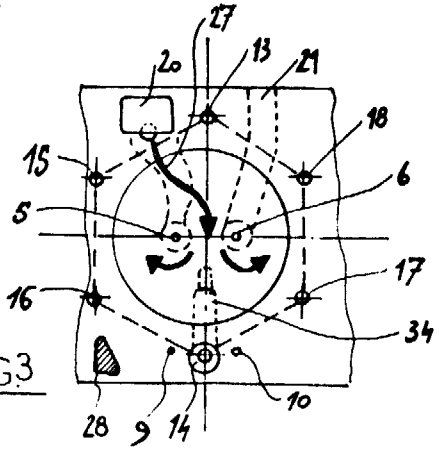
FIG. 3 is a schematic plan view illustrating operation of the engine.
Figure 6:
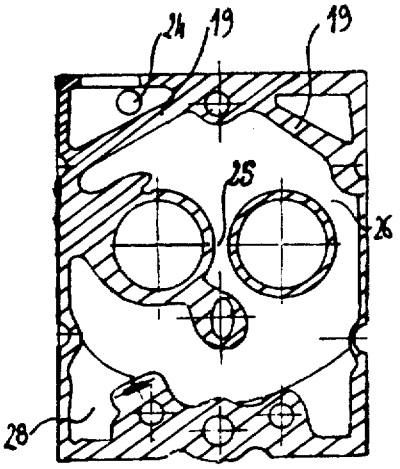
FIG. 6 is a section along line VI—VI (FIG. 8).
Figure 7:
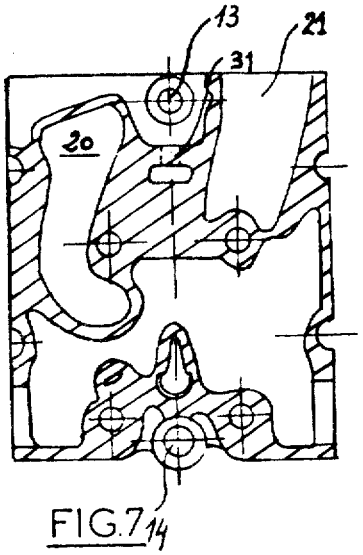
FIG. 7 is a section along line VII—VII (FIG. 8).
Figure 9:
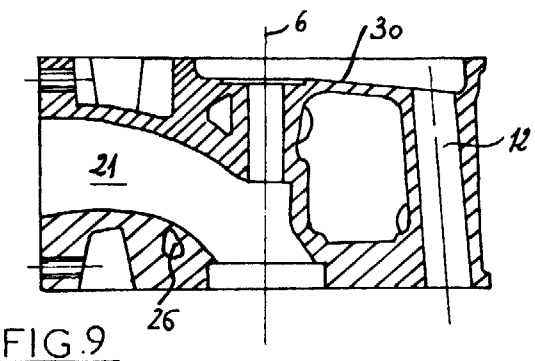
FIG. 9 is a section along line IX—IX (FIG. 5).
Figure 11:
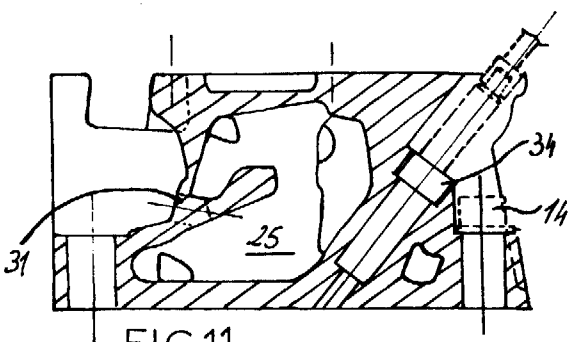
FIG. 11 is a section along line X1—X1 (FIG. 5).
Figure 8:
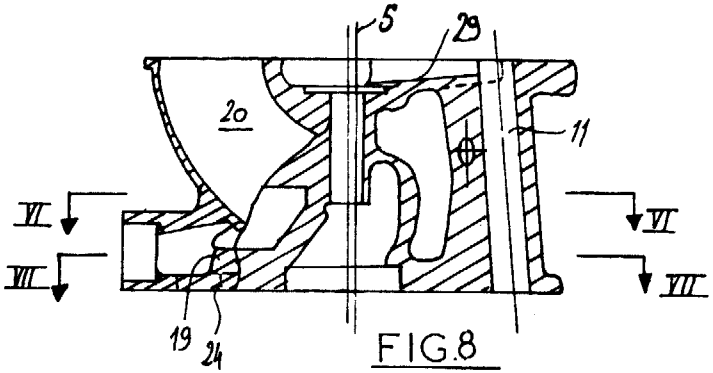
FIG. 8 is a section along line VIII—VIII (FIG. 5).
Figure 10:
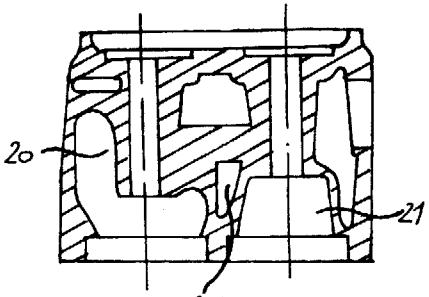
FIG. 10 is a section along line X—X (FIG. 5).
Figure 12:
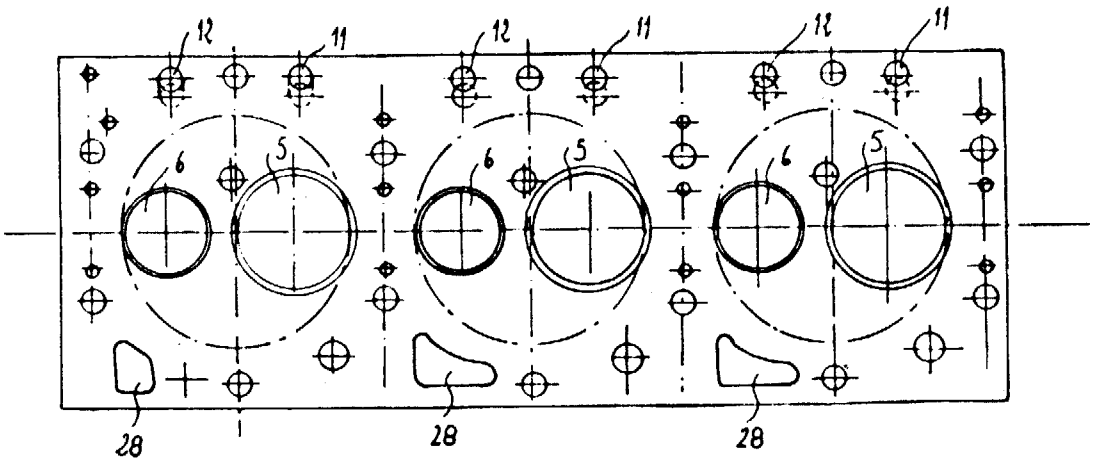
FIG. 12 is a view from below of a multi-cylinder cylinder head according to another embodiment of the invention.

The circuit in the cylinder head reserved for the cooling fluid has an entry opening 24 located below the inlet manifold 20 (FIG. 8). From the entry opening 24 the greatest proportion of the flow of the cooling liquid is channelled on to the bridge between the valves, i.e., in a channel 25 which passes between the two valves (FIGS. 6 and 10). A small part of the flow is elsewhere channelled into a passage 26 which extends below the exhaust manifold 21 (FIGS. 6 and 9). Thus, as is shown by arrows 27 in FIG. 3, the main flow of cooling liquid arrives straight onto the seating of the injector carrier 34. The cooling liquid leaves the head again by an opening 28 in the upper face of the head, this opening being located by the side of the injector.

The wall 29 which separates the channels of the cooling circuit from the space reserved for the inlet rocker arm 7 slopes downwardly from the hold 11 to the valve 5. On the other head, the wall 30 which separates the channels of the cooling circuit from the sapce reserved for the exhaust rocker arm 8 slopes downwardly in the opposite direction, i.e., going from the valve 6 to the hole 12 (see FIGS. 8 and 9). It will be seen in addition that the lowest point of the bowl in which the rocker arms are located in the upper part of the head is found at the hole 12 in which moves the push-rod 10 controlling the exhaust rocker arm 8. This hole 12 is of greater diameter than the hole 11 associated with the inlet rocker arm in order to allow the oil to fall back into the engine block. At the same time, the slopes of the walls 29 and 30 facilitate the removal of gases from the cooling circuit.

The use of the two short screws 13 and 14 ensures a better seal by the head gasket under the effect of the pressure forces. This is made possible due to the arrangement of the inlet and exhaust manifolds 20 and 21, located on the same side of the head, the bolt 13 being situated between the manifolds 20 and 21, while the injector carrier 34 can pass above the bolt 14. The injector is relatively inclined and is seated in a small boss directly into the head. It is not therefore necessary to attach the injection socket. In addition, by placing the push-rods 9 and 10 on each side of the injector, it is possible to design rocker arms which are less bulky than on conventional engines. This, combined with the fact that the six bolts 13 to 18 may be placed very close to the collar of the corresponding cylinder liner, leads to an appreciable reduction in the bulk of the engine in that the upper part of the engine is of smaller width.

The inlet and exhaust manifolds being located on the same side, it is possible to design a supercharged engine without having to have connecting tubes going from one side of the engine to the other, causing additional bulk above, behind, or in front of the engine.

The substantial limiting of the contact between the cooling circuit and the exhaust manifold provides a double advantage. In the first place, there results a clear reduction of the calories removed by means of the cooling liquid. This allows a reduction in the bulk of the cooling radiator and of the overall cooling apparatus. In the second place, it is advantageous not to cool the exhaust gases in the case of a supercharged engine; in this manner the supercharging turbo-compressor is given better output.

The position of the exhaust manifold 21, opposite to the push-rods and to the hole 12 through which the oil returns into the engine block, results in a reduction in the transfer of heat to the oil. The reduction in the number of calories to be carried away by the oil allows the heat exchanger between the oil and water circuits to be reduced in size, and even in certain cases to be dispensed with.

I claim:

1. a cylinder head for a diesel engine, comprising:
an inlet manifold and an exhaust manifold;
rocker arms;
an injector;
said inlet manifold and said exhaust manifold being disposed on the same side of said cylinder head, opposite to said rocker arms and said injector;
said cylinder head being affixed to an engine block by an arrangement of six bolts;
each of said six bolts defining, when viewed from above, one of the points of a regular hexagon, two sides of said hexagon being perpendicular to the central longitudinal plane of the engine;
said inlet manifold opening onto the upper face of said cylinder head;
said exhaust manifold opening onto a lateral face of said cylinder head;
said injector being fixed directly into a seating in said cylinder head in an inclined position relative to the central longitudinal plane of the engine and parallel to the axis of a cylinder of the engine, so as to extend above a relatively short one of said bolts which fixes said head to the engine block; and
said injector being fixed in the seating thereof between two rocker arm push-rods.

2. A cylinder head according to claim 1, wherein:
said six bolts include four relatively long bolts having head portions which bear on the upper surface of said cylinder head, and two relatively short bolts disposed in recesses symmetrical in relation to the central longitudinal plane of the engine, respectively, between said inlet and exhaust manifolds and above said injector; and
ribs are provided in the lower part of said cylinder head extending at right angles to the bearing zones of said cylinder head on a collar of a corresponding cylinder liner, each of said ribs extending between one of said relatively short bolts and one of said relatively long bolts.

3. A cylinder head according to claim 1, wherein:
said cylinder head includes a cooling liquid circuit therewithin, said cooling liquid circuit having an entry disposed below said inlet manifold in the lower face of said cylinder head.

4. A cylinder head according to claim 3, wherein:
said cooling liquid circuit comprises a channel which directs the greater part of flow from said entry into a bridge defined between two valves to said cylinder head, and then against a boss in which said injector is seated.

5. A cylinder head according to claim 3, wherein:
said cooling liquid circuit comprises a channel which directs a small part of the output from said entry around said exhaust manifold.

6. A cylinder head according to claim 3, wherein:
said cooling liquid circuit comprises an outlet disposed on the upper face of said cylinder head at the side of said injector.

7. A cylinder head according to claim 6, wherein:
said cylinder head includes walls which separate the channels of said cooling circuit from space reserved for said rocker arms in the upper part of said cylinder head; and
said walls slope upwardly from said entry of said cooling circuit, disposed proximal to said inlet manifold, to said outlet of said cooling circuit, disposed proximal to said injector.

8. A cylinder head according to claim 1, wherein:
said cylinder head includes in the upper part thereof a bowl portion for said rocker arms, the lowest point of said bowl portion being disposed at a hole which receives a push-rod of one of said rocker arms, said rocker arm comprising an exhaust rocker arm; and
said hole is larger than a hole which receives a push-rod of a second one of said rocker arms which comprises an inlet rocker arm, and provides an oil passage permitting oil to run down from said bowl portion into the engine block.

9. A cylinder head according to claim 2, wherein:

said cylinder head comprises a unitary, single-cylinder cylinder head; and said four relatively long bolts comprise two pairs of relatively long bolts, each of said pairs straddling two cylinder heads in a case when another cylinder head is disposed at the side corresponding to said pair of long bolts.

10. A cylinder head according to claim 2, wherein:

said cylinder head comprises a multi-cylinder cylinder head having a unitary construction for several cylinders;

each cylinder has associated therewith said six bolts; and two adjacent cylinders of said cylinder head have two of said relatively long bolts in common.

* * * * *